US010762863B2

(12) United States Patent
Wang

(10) Patent No.: US 10,762,863 B2
(45) Date of Patent: Sep. 1, 2020

(54) DEVICE AND METHOD OF DRIVING DISPLAY PANEL

(71) Applicants: HKC CORPORATION LIMITED, Shenzhen, Guangdong (CN); CHONGQING HKC OPTOELECTRONICS TECHNOLOGY CO., LTD., Chongqing (CN)

(72) Inventor: Mingliang Wang, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 16/313,859

(22) PCT Filed: Nov. 30, 2018

(86) PCT No.: PCT/CN2018/118444
§ 371 (c)(1),
(2) Date: Dec. 27, 2018

(87) PCT Pub. No.: WO2020/052099
PCT Pub. Date: Mar. 19, 2020

(65) Prior Publication Data

US 2020/0082773 A1 Mar. 12, 2020

(30) Foreign Application Priority Data

Sep. 11, 2018 (CN) ..... 2018 1 1056953

(51) Int. Cl.
*G09G 3/36* (2006.01)

(52) U.S. Cl.
CPC ... *G09G 3/3648* (2013.01); *G09G 2310/0264* (2013.01); *G09G 2320/0219* (2013.01)

(58) Field of Classification Search
CPC ..... G09G 3/3648; G09G 2310/0264; G09G 2320/0219
See application file for complete search history.

(56) References Cited

U.S. PATENT DOCUMENTS

2012/0162165 A1* 6/2012 Lee ..... G09G 3/006 345/206
2012/0169695 A1* 7/2012 Chang ..... G09G 3/3648 345/211
2013/0044085 A1* 2/2013 Lin ..... G09G 3/3677 345/204
2016/0179275 A1* 6/2016 Lee ..... G06F 3/044 345/174

* cited by examiner

*Primary Examiner* — Brent D Castiaux

(57) ABSTRACT

An embodiment of the present disclosure provides a device of driving a display panel, comprising: a control circuit, a memory circuit, a timing circuit and a resistance circuit; where the control circuit is configured to read resistance control data stored in the memory circuit and output the resistance control data to the timing circuit and the resistance circuit, the resistance circuit is configured to adjust its own resistance according to the received resistance control data.

20 Claims, 3 Drawing Sheets

DEVICE AND METHOD OF DRIVING DISPLAY PANEL

CROSS-REFERENCE TO RELATED APPLICATION

This application is the US national stage application of PCT International Application No. PCT/CN2018/118444, which was filed Nov. 30, 2018 and claimed priority to Chinese Patent Application No. 201811056953.4, filed on Sep. 11, 2018. The content of Chinese Patent Application No. 201811056953.4 is incorporated herein by reference.

TECHNICAL FIELD

The present disclosure pertains to the field of display technology, and more particularly to a device of a driving a display panel and a method of driving a display panel.

BACKGROUND

The statements herein only provide background information related to the present disclosure without necessarily constituting the prior art. TFT-LCD (Thin Film Transistor Liquid Crystal Display) has the advantages of low cost, low power consumption and high performance, and has been widely used in the fields such as electronics, digital products and so on. However, driving of the pixel units in the display panel needs to be implemented by using a gate drive circuit and a source drive circuit to drive corresponding scanning line and data line. With the improvement of the requirements of size, resolution, large view angle and image quality of the display panel, user experience is further improved, the cost is further saved, various manufacturers have developed a lot of manufacturing technologies related to the display field.

In the display panel, due to the influence of capacitive coupling effect, when the TFT (Thin Film Transistor) is closed and turned off, a voltage stability of data signal is influenced, and the image quality is further influenced; thus, it needs to perform a wave clipping on VGH (Voltage Gate High) of TFT so as to reduce a voltage difference between the VGH and VGL (Voltage Gate Low) of the TFT when the TFT is turned off, and to reduce the influence of the voltage of the data signal. For example, a resistance grounding discharge method is adopted to achieve the purpose of wave clipping, one end of a clipping resistance is connected with a power supply integrated circuit and the other end of the clipping resistance is grounded; the VGH generated by the power supply integrated circuit is discharged through the clipping resistance to form a clipped voltage waveform. The clipped voltage waveforms formed by the VGH are also the same for the clipping resistances having the same resistance value. Due to the fact that a clipped voltage waveform may influence pixel charging time and cause a horizontal block phenomenon (i.e., horizontal block is poor), for this reason, the clipped voltage waveform of the VGH needs to be controlled, so that the influence on pixel charging time is reduced and the horizontal block phenomenon is avoided; thus, clipping resistances need to be changed continuously in order to find an optimal resistance having the minimum influence on pixel charging time, this method needs many times of repetitive operation, is relatively tedious, and has a low working efficiency.

SUMMARY

An object of the present disclosure is to provide a device of driving a display panel, which solves technical problems including but is not limited to a technical problem that due to the influence of capacitance coupling effect, a voltage stability of data signal is influenced and image quality is further affected when TFT is closed and turned off.

In order to solve the aforesaid technical problem, a technical solution adopted by the embodiment of the present disclosure is as follows:

a device of driving a display panel, including:

a control circuit;

a memory circuit configured to be coupled with the control circuit, and store and output a plurality of resistance control data;

a timing circuit configured to be coupled with the control circuit; and a resistance circuit configured to be coupled with the control circuit and including a resistance controller;

where the control circuit is configured to read the resistance control data in the memory circuit and output the resistance control data to the timing circuit and the resistance circuit, and the resistance circuit is configured to adjust its own resistance according to the received resistance control data.

In some embodiments, the timing circuit is configured to start timing and sent a timing termination signal to the control circuit, when the resistance circuit adjusts its own resistance according to the received resistance control data.

In some embodiments, the resistance control data includes resistance value data and timing data.

In some embodiments, the timing circuit is configured to receive the timing data and perform timing, and output a feedback signal to the control circuit simultaneously.

In some embodiments, the resistance controller is coupled with a plurality of switches and each switch is correspondingly coupled with a resistance.

In some embodiments, at least one of the switches is turned off, so that at least one of the resistance circuits is conductive.

In some embodiments, one of the switches is turned off, so that the resistance in the resistance circuit is conductive.

In some embodiments, the resistance controller is configured to turn off the corresponding switch according to the resistance value data.

In some embodiments, the resistance controller and the switches are in an off state before the display panel is actuated.

In some embodiments, the resistance controller is coupled with the corresponding resistance respectively through a coupling element.

In some embodiments, the coupling element further includes a protection element.

In some embodiments, the protection element is any one of a fuse, a fusing resistance, a temperature control semiconductor element and a thermosensitive semiconductor element.

In some embodiments, the timing circuit is configured to restart timing, when the resistance control data read by the control circuit is changed.

In some embodiments, a device of driving a display panel includes:

a control circuit;

a memory circuit configured to be coupled with the control circuit, and store and output a plurality of resistance control data;

a timing circuit configured to be coupled with the control circuit;

a resistance circuit configured to be coupled with the control circuit and including a resistance controller; and a plurality of switches configured to enable the resistance controller to be coupled with each resistance respectively;

where the control circuit is configured to read the plurality of resistance control data in the memory circuit and output the resistance control data to the timing circuit and the resistance circuit; the resistance circuit is configured to receive the resistance control data and adjust its own resistance value according to the received resistance control data;

the control circuit is configured to control the resistance circuit to turn off one or more of the plurality of switches to enable at least one resistance in the resistance circuit to be conductive, so that the resistance circuit has different resistance value corresponding;

the timing circuit is configured to restart timing when the resistance control data read by the control circuit is changed.

Another object of the present disclosure is to provide a method of driving a display panel, including:

setting a control circuit;

setting a memory circuit which is configured to be coupled with the control circuit, and store and output a plurality of resistance control data;

setting a timing circuit which is configured to be coupled to the control circuit; setting a resistance circuit which is configured to be coupled with the control circuit and comprises a resistance controller;

where the control circuit is configured to read the resistance control data in the memory circuit and output the resistance control data to the timing circuit and the resistance circuit; the resistance circuit is configured to receive the resistance control data and adjust its own resistance value according to the received control data;

where the resistance controller is coupled with a plurality of switches and each of the switches is coupled with a corresponding resistance respectively; the control circuit is configured to control the resistance circuit to turn off one or more switches in the plurality of switches to enable one or more resistances in the resistance circuit to be conductive, so that the resistance circuit has a corresponding resistance value.

In some embodiments, the method of driving display panel further includes:

restarting timing via the timing circuit when the resistance control data read by the control circuit is changed.

In some embodiments, the method of driving display panel further includes:

configuring the timing circuit to start timing and transmitting a timing termination signal to the control circuit when the resistance circuit adjusts its own resistance according to the received resistance control data.

In some embodiments, the resistance control data includes resistance value data and timing data; and the timing circuit is configured to receive the timing data and perform timing, and output a feedback signal to the control circuit simultaneously.

In some embodiments, the method of driving display panel further includes:

setting the resistance controller and the switches as in an off state before the display panel is actuated.

In some embodiments, the method of driving display panel further includes:

coupling the resistance controller with the corresponding resistances respectively through a coupling element.

In the device and method of driving display panel provided by the embodiments of the present disclosure, according to the design of the clipping circuit, a voltage waveform clipping approach may be improved, and using the same circuit to output various different clipped voltage waveforms may be implemented, the number of clipping resistances is saved, and the voltage waveform needs not to be adjusted through a welding resistance, the efficiency of displaying is improved, and the cost of the display panel is saved.

BRIEF DESCRIPTION OF THE DRAWINGS

In order to explain this embodiments of the present disclosure more clearly, a brief introduction regarding the accompanying drawings that need to be used for describing the embodiments is given below; it is obvious that the accompanying drawings described as follows are only some embodiments of the present disclosure, for ordinarily skilled one in the art, other drawings can also be obtained according to the current drawings on the premise of paying no creative labor.

DESCRIPTION OF THE EMBODIMENTS

In order to make the purpose, the technical solution and the advantages of the present disclosure be clearer and more understandable, the present disclosure is further described in detail below with reference to accompanying figures and embodiments. It should be understood that the specific embodiments described herein are merely intended to illustrate but not to limit the present disclosure.

It should be noted that, when one component is described to be "fixed to" or "arranged on" another component, this component may be directly or indirectly arranged on another component. When one component is described to be "connected with" another component, it may be directly or indirectly connected to the other component. Orientation or position relationships indicated by terms including "upper", "lower", "left" and "right" are based on the orientation or position relationships shown in the accompanying figures and is only used for the convenience of description, instead of indicating or implying that the indicated device or element must have a specific orientation and is constructed and operated in a particular orientation, and thus should not be interpreted as limitation to the present disclosure. For the person of ordinary skill in the art, the specific meanings of the aforesaid terms may be interpreted according to specific conditions. Terms of "the first" and "the second" are only for the purpose of describing conveniently and should not be interpreted as indicating or implying relative importance or impliedly indicating the number of indicated technical features. "Multiple/a plurality of" means two or more unless there is an additional explicit and specific limitation.

Figure 1:
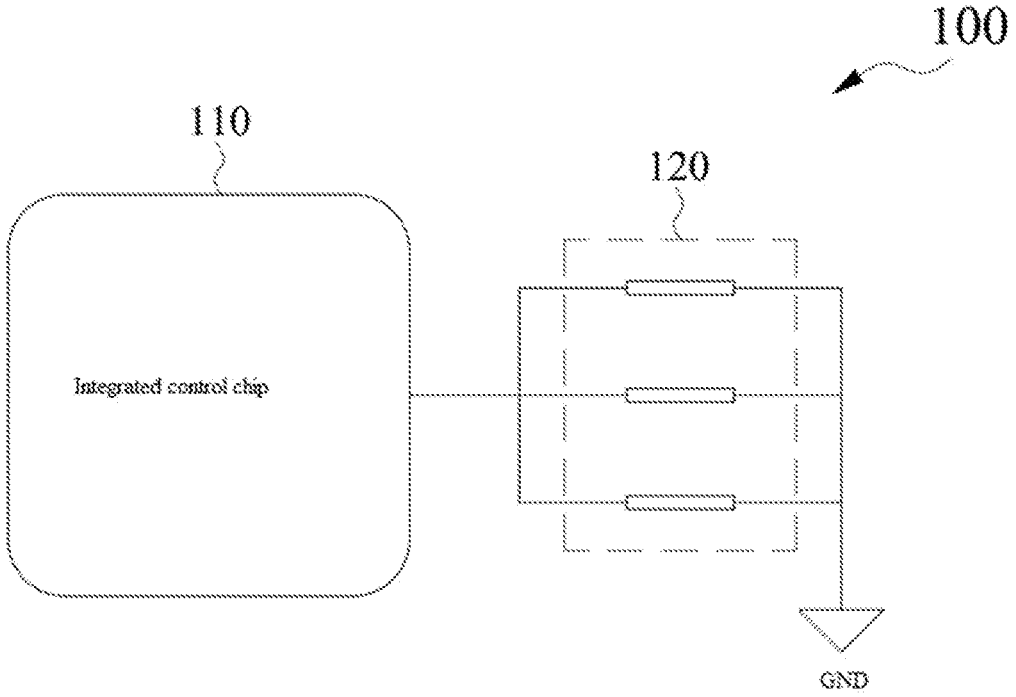
FIG. 1 illustrates a circuit diagram of a clipping circuit configuration provided by an embodiment of the present disclosure.

FIG. 1 illustrates a schematic diagram of a clipping circuit configuration provided by an embodiment of the present disclosure.

Figure 2:
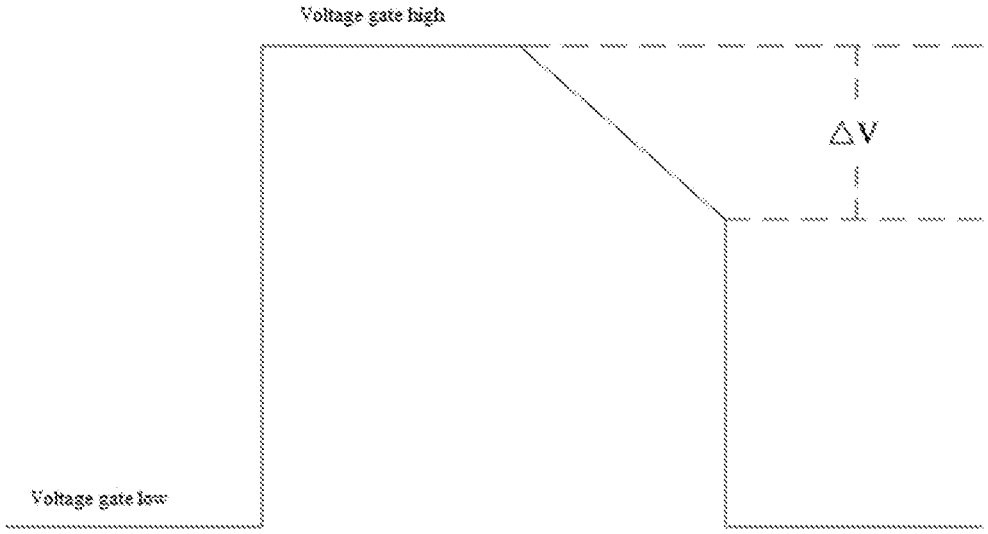
FIG. 2 illustrates a schematic diagram of clipped voltage waveform provided by an embodiment of the present disclosure.

FIG. 2 illustrates a schematic diagram of a clipped voltage waveform provided by an embodiment of the present disclosure.

Referring to FIG. 1 and FIG. 2, an exemplary clipping circuit configuration 100 includes:

an integrated control chip 110 and a clipping resistance 120.

One end of the clipping resistance 120 is coupled with the integrated control chip 110, the other end of the clipping resistance 120 is grounded. A VGH (Voltage Gate High) is generated by the integrated control chip 110, and a clipped voltage ΔV (as shown in FIG. 2) is generated after the VGH passes through the clipping resistance 120. Where, clipped voltage waveforms formed by the VGH are also the same for those clipping resistances having the same resistance value. Due to the fact that the clipped voltage waveform may influence pixel charging time and cause a horizontal block phenomenon (i.e., the horizontal block is poor), thus, the clipped voltage waveform generated by the VGH needs to be controlled, so that the influence on the pixel charging time is reduced and the horizontal block phenomenon is avoided.

Figure 3:
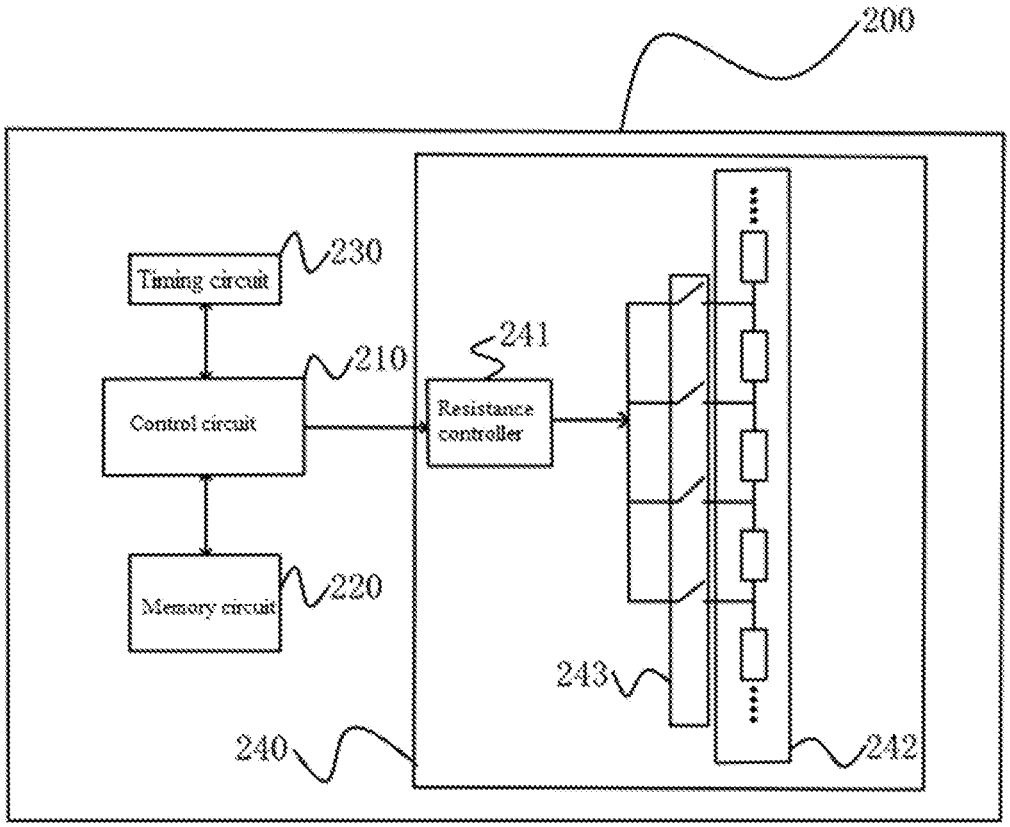
FIG. 3 illustrates another circuit diagram of the clipping circuit configuration provided by an embodiment of the present disclosure.

FIG. 3 illustrates another schematic diagram of a clipping circuit configuration provided by an embodiment of the present disclosure.

Figure 4:
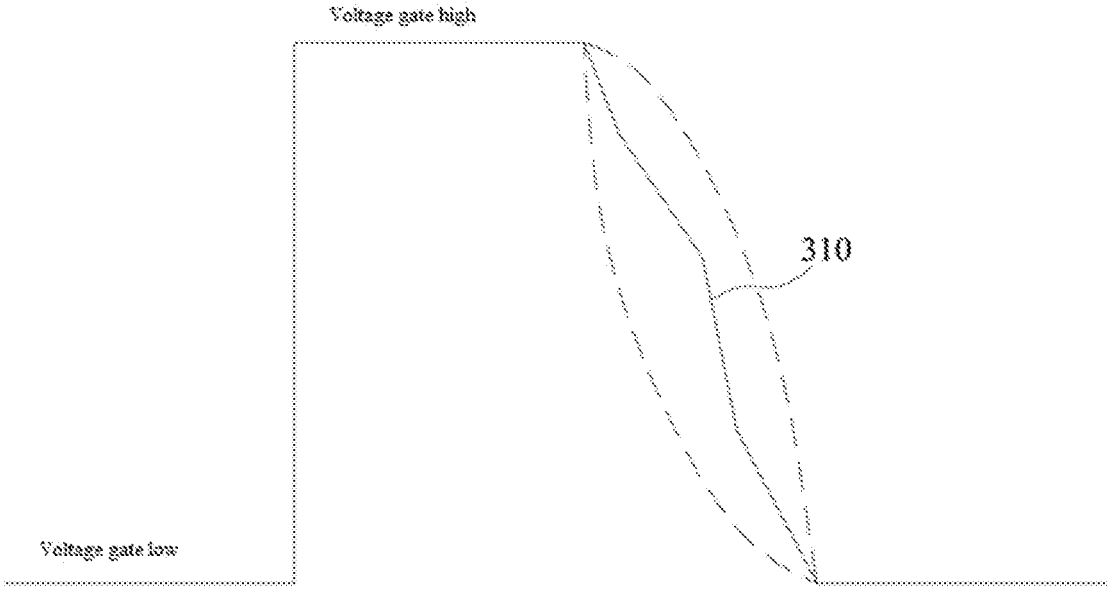
FIG. 4 illustrates another schematic diagram of the clipped voltage waveform provided by an embodiment of the present disclosure.

FIG. 4 illustrates another schematic diagram of a clipping voltage waveform provided by an embodiment of the present disclosure.

Referring to FIG. 3 and FIG. 4, In some embodiments, a device 200 of driving a display panel includes:

a control circuit 210;

a memory circuit 220 configured to be coupled with the control circuit 210 and store and output a plurality of resistance control data;

a timing circuit 230 configured to be coupled with the control circuit 210, perform timing and output a feedback signal;

a resistance circuit 240 configured to be coupled with the control circuit 210; where the control circuit 210 is configured to read the resistance control data in the memory circuit 220 and output the resistance control data to the timing circuit 230 and the resistance circuit 240; the resistance circuit 240 is configured to adjust its own resistance according to the received resistance control data.

In some embodiments, when the resistance circuit 240 adjusts its own resistance according to the received resistance control data, the timing circuit 230 is configured to start timing and transmit a timing termination signal to the control circuit 210; In some embodiments, the resistance control data includes resistance value data and timing data.

In some embodiments, the timing circuit 230 is configured to receive the resistance control data and perform timing, and output a feedback signal to the control circuit 210 simultaneously.

In some embodiments, the resistance controller 241 is enabled to be coupled with each resistance 242 respectively through a plurality of switches 243.

In some embodiments, at least one of the switches 243 is turned on, so that at least one resistance 242 in the resistance circuit 240 is conductive.

In some embodiments, one of the switches 243 is turned on, so that the corresponding resistance 242 in the resistance circuit 240 is conductive.

In some embodiments, when different switches 243 are closed, the resistance value of the resistance circuit 240 is also different. In some embodiments, a switch 243 configured to connect a digital resistance controller 241 with the resistance 242 is disconnected before the display panel is actuated.

In some embodiments, when the display panel is actuated, the control circuit 210 reads the resistance control data stored in the memory circuit 220 to obtain the required timing data and resistance value data corresponding to the timing data, and output the timing data and the resistance value data to the timing circuit 230 and the resistance controller 241 respectively.

In some embodiments, the resistance controller 241 turns off the corresponding switch 243 according to the received resistance data, so that the total resistance value of the resistance circuit 240 is equal to the resistance value data as output by the control circuit 210.

In some embodiments, when the resistance control data read by the control circuit 210 is changed, the resistance control data is output to the timing circuit 230 and the resistance circuit 240 respectively, the timing circuit 230 restarts timing, and the resistance circuit 240 changes its own resistance value simultaneously.

Referring to FIG. 3 and FIG. 4, in some embodiments, the device 200 of driving display panel enables the voltage waveform of the output voltage (i.e., the voltage gate high) to be bevel, which is shown in FIG. 4. An adjustment range of the output voltage waveform may be such as a range between two dotted lines shown in FIG. 4; where a waveform 310 is an exemplary output voltage waveform which is within the adjustment range. The adjustment range of the output voltage waveform of FIG. 4 is merely illustrative and is not intended to limit the size or the area of the adjustment range, the adjustment range is determined by the design of the designer.

Figure 5:
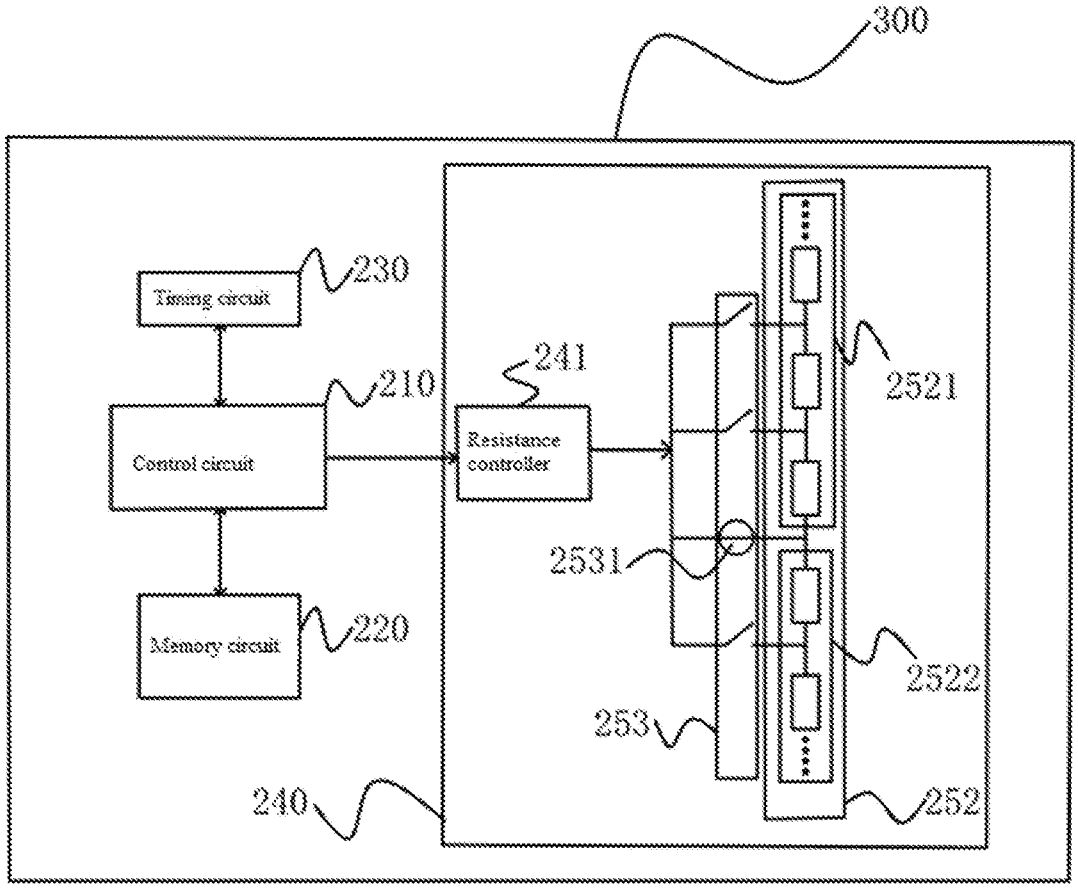
FIG. 5 illustrates another circuit diagram of the clipping circuit configuration provided by an embodiment of the present disclosure.

FIG. 5 illustrates another schematic diagram of the clipping circuit configuration according to an embodiment of the present disclosure.

Referring to FIG. 5 and FIG. 4, in some embodiments, a device 300 of driving display panel includes:

a control circuit 210;

a memory circuit 220 configured to store a plurality of resistance control data and is coupled with the control circuit 210;

a timing circuit 230 configured to be coupled with the control circuit 210;

a resistance circuit 240 configured to be coupled with the control circuit 210 and including a resistance controller 241; where the control circuit 210 is configured to read the resistance control data of the memory circuit 220 including resistance value data and timing data, and output the resistance value data and the timing data to the resistance circuit 240 and the timing circuit 230 respectively.

In some embodiments, the resistance circuit 240 changes its own resistance value, the timing circuit 230 starts timing and transmits a feedback signal to the control circuit 210; when the control circuit 210 receives the feedback signal indicating that current timing is stopped, the next set of resistance control data is read and is output to the resistance circuit 240 and the timing circuit 230 respectively; the resistance circuit 240 changes its own resistance value and the timing circuit 230 restarts timing.

In some embodiments, the resistance control data includes resistance value data and timing data.

In some embodiments, the timing circuit is configured to receive the resistance control data and perform timing, and output the feedback signal to the control circuit simultaneously.

In some embodiments, referring to FIG. 5, two ends of the resistance circuit 242 is grounded (not shown) before the display panel is actuated, switches in the switch circuit 243 are disconnected; when the display panel is actuated, referring to FIG. 5, the control circuit 210 outputs the resistance control data to the resistance controller 241, the resistance controller 241 outputs an instruction of closing the coupling element 2531, the remaining coupling elements are still in an off state; at this moment, the resistance is divided into a first part resistance and a second part resistance; where an equivalent resistance value of the first part resistance 2521 is R1, an equivalent resistance value of the second partial resistance is R2, at this time, the equivalent resistance value of the resistance circuit 252 is formulated as R1*R2/(R1+R2).

In some embodiments, the resistance controller 241 is enabled to be coupled with each resistance 252 respectively through a plurality of coupling elements 253.

In some embodiments, the resistance controller 241 is communicated with the resistance 252 by closing one of the plurality of coupling elements 253, so that the resistance circuit 240 has corresponding different resistance value.

In some embodiments, the control circuit 210 controls the corresponding coupling element 253 to be closed according to the read resistance value data and adjusts the resistance value of the resistance 252 to be the same as or similar to the resistance value.

In some embodiments, the coupling element 253 may include a protection element which may be any one of a fuse, a temperature control semiconductor element and a thermosensitive semiconductor element, a stability of the driving device of the display panel may be improved by setting the protection element.

In some embodiments, the timing circuit 230 is configured to restart timing when the resistance control data read by the control circuit 210 is changed.

The memory circuit 220 may be an internal storage unit of the display device, such as a hard disk or a memory of the display device. The memory circuit 220 may also be an external storage device of the display device, such as a plug-in hard disk, a SMC (Smart Media Card), a SD (Secure Digital) card, a FC (Flash Card) equipped on the display device.

Further, the memory circuit 220 may also include the internal storage unit and the external storage device of the display device 10.

In some embodiments, the memory circuit 220 is configured to store computer program and other programs and data needed by the display device.

In some embodiments, the memory circuit 220 may also be configured to temporarily store data that has been output or is ready to be output.

The so called control circuit 210 may be CPU (Central Processing Unit), and can also be other general purpose processor, DSP (Digital Signal Processor), ASIC (Application Specific Integrated Circuit), FGPA (Field-Programmable Gate Array), or some other programmable logic devices, discrete gate or transistor logic device, discrete hardware component, etc. The general purpose processor may be a microprocessor, or alternatively, the processor may also be any conventional processor and so on.

Referring to FIGS. 3-5, In some embodiments, the embodiment of the present disclosure provides a method of driving a display panel, including:

setting a control circuit 210;

setting a memory circuit 220 which is configured to be coupled with the control circuit 210 and store and output a plurality of resistance control data;

setting a timing circuit 230 which is coupled with the control circuit 210;

setting a resistance circuit 240 which is configured to be coupled with the control circuit 210 and includes a resistance controller 241;

The control circuit 210 is configured to read the resistance control data stored in the memory circuit 220, and output the resistance control data to the timing circuit 230 and the resistance circuit 240;

The resistance circuit 240 is configured to adjust its own resistance value according to the received resistance control data; where the resistance controller is coupled with a plurality of switches, and each of the switches is correspondingly coupled with each resistance respectively; the control circuit 210 is configured to control the resistance circuit to close one or more switches in the plurality of switches to enable all or some resistances 252 in the resistance circuit 240 to be conductive, so that the resistance circuit has corresponding different resistance value.

In some embodiments, the control circuit 210 is configured to control the switch 243 to be closed and adjust the resistance value of the resistance 252 into the same as or similar to the resistance value according to the read resistance value data.

In some embodiments, the control circuit 210 is configured to control the corresponding coupling element 253 to be closed and adjust the resistance value of the resistance 252 into the same as or similar to the resistance value data according to the read resistance value data.

In some embodiments, the control circuit 210 is configured to control the resistance controller 241 to close one or more switches in the switches 243 or close one or more switches in the coupling element 253 according to the resistance value data.

In some embodiments, the method of driving display panel further includes:

a resistance circuit is configured to start timing and transmit a timing termination signal to the control circuit when the resistance circuit adjusts its own resistance according to the received resistance control data.

In some embodiments, the resistance control data includes resistance value data and timing data;

the timing circuit is configured to receive the timing data and perform timing, and output a feedback signal to the control circuit simultaneously.

In some embodiments, the driving method further includes:

setting the resistance controller and the switch as disconnected before the display panel is actuated.

In some embodiments, the method of driving display panel further includes:

coupling the resistance controller with the corresponding resistance respectively through the coupling element 253.

In some embodiments, the display panel of the present disclosure may be such as a LCD (Liquid Crystal Display) panel, however, the display panel of the present disclosure is not limited herein and may also be an OLED (Organic Light Emitting Diode) display panel, a W-OLED (White Light Emitting Diode) display panel and a QLED (Quantum Dot Light Emitting Diode) display panel, a plasma display panel, a curved type display panel or other types of display panels.

According to the design of the clipping circuit, a voltage waveform clipping approach may be improved, and using the same circuit to output various different clipped voltage waveforms may be implemented, the number of clipping resistances is saved, and the voltage waveform needs not to be adjusted through a welding resistance, the efficiency of displaying is improved, and the cost of the display panel is saved.

The aforementioned embodiments are only optional embodiments of the present disclosure, and should not be regarded as being limitation to the present disclosure. Any modification, equivalent replacement, improvement, and the like, which are made within the spirit and the principle of the present disclosure, should all be included in the protection scope of the present disclosure.

What is claimed is:

1. A device of driving a display panel, comprising:

a control circuit;

a memory circuit configured to be coupled with the control circuit, and store and output a plurality of resistance control data;

a timing circuit configured to be coupled with the control circuit; and a clipping resistance circuit configured to be coupled with the control circuit and comprising a resistance controller;

a plurality of switches;

wherein each of the a plurality of switches is coupled between the resistance controller and one resistance in series; and the control circuit is configured to read the resistance control data in the memory circuit and output the resistance control data to the timing circuit and the clipping resistance circuit, and the clipping resistance circuit is configured to adjust its own resistance according to the received resistance control data to form a VGH (Voltage Gate High) with clipped voltage waveform.

2. The device of driving display panel according to claim 1, wherein the timing circuit is configured to start timing and send a timing termination signal to the control circuit, when the clipping resistance circuit adjusts its own resistance according to the received resistance control data.

3. The device of driving display panel according to claim 1, wherein the resistance control data comprises resistance value data and timing data.

4. The device of driving the display panel according to claim 3, wherein the timing circuit is configured to receive the timing data and perform timing, and output a feedback signal to the control circuit simultaneously.

5. The device of driving display panel according to claim 1, wherein at least one of the switches is tinned off, so that at least one of the clipping resistance circuits is conductive.

6. The device of driving, display panel according to claim 1, wherein one of the switches is turned off, so that the resistance in the clipping resistance circuit is conductive.

7. The device of driving the display panel according to claim 1, wherein the resistance controller is configured to turn off the corresponding switch according to the resistance value data.

8. The device of driving the display panel according to claim 1, wherein the resistance controller and the switches are in an off state before the display panel is actuated.

9. The device of driving the display panel according to claim 1, wherein the resistance controller is coupled with the corresponding resistance respectively through a coupling element.

10. The device of driving display panel according to claim 9, wherein the coupling element further comprises a protection element.

11. The device of driving display panel according to claim 1, wherein the timing circuit is configured to restart timing, when the resistance control data read by the control circuit is changed.

12. The device of driving display panel according to claim 1, wherein during a period of the clipped voltage waveform, the resistance of the resistance is adjusted multiple times to make a slope of the clipped voltage waveform change multiple times.

13. The device of driving display panel according to claim 12, wherein during a period of the clipped voltage waveform, the resistance of the resistance is adjusted four times to make the slope of the clipped voltage waveform change four times.

14. A device of driving a display panel, comprising:

a control circuit;

a memory circuit configured to be coupled with the control circuit, and store and output a plurality of resistance control data;

a timing circuit configured to be coupled with the control circuit;

a clipping resistance circuit configured to be coupled with the control circuit and comprising a resistance controller; and a plurality of switches configured to enable the resistance controller to be coupled with each resistance respectively;

wherein each of the a plurality of switches is coupled between the resistance controller and one resistance in series; and the control circuit is configured to read the plurality of resistance control data in the memory circuit and output the resistance control data to the timing circuit and the clipping resistance circuit; the clipping resistance circuit is configured to receive the resistance control data and adjust its own resistance value according to the received resistance control data to form a clipped voltage waveform;

the control circuit is configured to control the clipping resistance circuit to turn off one or more of the plurality of switches to enable at least one resistance in the clipping resistance circuit to be conductive, so that the clipping resistance circuit has different resistance value corresponding; and the timing circuit is configured to restart timing when the resistance control data read by the control circuit is changed.

15. A method of driving a display panel, comprising:

setting a control circuit;

setting a memory circuit which is configured to be coupled with the control circuit, and store and output a plurality of resistance control data;

setting a timing circuit which is configured to be coupled to the control circuit;

setting a clipping resistance circuit which is configured to be coupled with the control circuit and comprises a resistance controller;

wherein the control circuit is configured to read the resistance control data in the memory circuit and output the resistance control data to the timing circuit and the clipping resistance circuit; the clipping resistance circuit is configured to receive the resistance control data and adjust its own resistance value according to the received resistance control data to form a clipped voltage waveform;

wherein the resistance controller is coupled with a plurality of switches and each of the switches is coupled with a corresponding resistance respectively; and each of the a plurality of switches is coupled between the resistance controller and one resistance series; the control circuit is configured to control the clipping resistance circuit to turn off one or more switches in the plurality of switches to enable one or more resistances in the clipping resistance circuit to be conductive, so that the clipping resistance circuit has a corresponding resistance value.

16. The method of driving display panel according to claim 15, further comprising:

restarting timing via the timing circuit when the resistance control data read by the control circuit is changed.

17. The method of driving display panel according to claim 15, further comprising:

configuring the timing circuit start timing and transmitting a timing termination signal to the control circuit when the clipping resistance circuit adjusts its own resistance according to the received resistance control data.

18. The method of driving display panel according to claim 15, wherein the resistance control data comprises resistance value data and timing data; the timing circuit is configured to receive the timing data and perform timing, and output a feedback signal to the control circuit simultaneously.

19. The method of driving display panel according to claim 15, further comprising:

setting the resistance controller and the switches as in an off state before the display panel is actuated.

20. The method of driving display panel according to claim 15, further comprising:

coupling the resistance controller with the corresponding resistances respectively through a coupling element.

* * * * *